US008384300B2

(12) United States Patent
Matloubian et al.

(10) Patent No.: US 8,384,300 B2
(45) Date of Patent: Feb. 26, 2013

(54) INTEGRATED RF ELECTRODELESS PLASMA LAMP DEVICE AND METHODS

(75) Inventors: Mehran Matloubian, Encino, CA (US); Frederick M. Espiau, Topanga, CA (US)

(73) Assignee: Topanga Technologies, Inc., Canoga Park, CA (US)

( * ) Notice: Subject to any disclaimer, the term of this patent is extended or adjusted under 35 U.S.C. 154(b) by 253 days.

(21) Appl. No.: 12/873,129

(22) Filed: Aug. 31, 2010

(65) Prior Publication Data

US 2011/0050099 A1 Mar. 3, 2011

Related U.S. Application Data

(60) Provisional application No. 61/239,056, filed on Sep. 1, 2009.

(51) Int. Cl.
*H05B 41/16* (2006.01)

(52) U.S. Cl. ..... 315/248; 313/161

(58) Field of Classification Search ..... 315/51, 315/248; 313/161
See application file for complete search history.

(56) References Cited

U.S. PATENT DOCUMENTS

| | | | | |
|---|---|---|---|---|
| 4,010,400 | A | 3/1977 | Hollister | |
| 4,041,352 | A | 8/1977 | McNeill et al. | |
| 4,070,603 | A | 1/1978 | Regan et al. | |
| 4,888,528 | A | 12/1989 | Byszewski et al. | |
| 5,030,889 | A | 7/1991 | El-Hamamsy et al. | |
| 5,200,672 | A | 4/1993 | Sheynberg et al. | |
| 5,808,414 | A * | 9/1998 | Wharmby et al. | 313/607 |
| 5,990,632 | A * | 11/1999 | Smith et al. | 315/248 |
| 6,097,137 | A * | 8/2000 | Forsdyke et al. | 313/161 |
| 6,379,985 | B1 | 4/2002 | Cervantes et al. | |
| 6,555,954 | B1 * | 4/2003 | Chandler et al. | 313/485 |
| 7,362,056 | B2 | 4/2008 | Espiau et al. | |
| 7,470,555 | B2 | 12/2008 | Matsumura | |
| 2006/0288928 | A1 | 12/2006 | Eom et al. | |
| 2007/0109069 | A1 | 5/2007 | Espiau et al. | |
| 2009/0081857 | A1 | 3/2009 | Hanser et al. | |

FOREIGN PATENT DOCUMENTS

WO WO2010120819 A1 10/2010

OTHER PUBLICATIONS

U.S. Appl. No. 12/759,273, filed Apr. 13, 2010, Raring et al.
U.S. Appl. No. 12/868,441, filed Aug. 25, 2010, Raring et al.
International Search Report and Written Opinion dated Oct. 25, 2010 for the corresponding PCT application PCT/US2010/047452.

* cited by examiner

*Primary Examiner* — Thuy Vinh Tran
(74) *Attorney, Agent, or Firm* — Kilpatrick Townsend & Stockton LLP

(57) ABSTRACT

An RF electrode-less plasma lighting device has a base member, which includes an outer region capable of being coupled to first AC potential and an inner region capable of being coupled to a second AC potential. In a preferred embodiment, the device has an RF module mechanically and integrally coupled to the base member. The RF module has an RF source, which has an output. The RF module has a first DC input and a second DC input. The first DC input of the RF module is coupled to a first DC potential and the second DC input of the RF module is coupled to a second DC potential. In a specific embodiment, the present device has an RF electrodeless plasma lighting assembly integrally coupled to the base member. The RF plasma lighting assembly has an RF input, which is coupled to the output of the RF source.

23 Claims, 11 Drawing Sheets

INTEGRATED RF ELECTRODELESS PLASMA LAMP DEVICE AND METHODS

CROSS-REFERENCES TO RELATED APPLICATIONS

This application claims priority to U.S. Provisional Patent Application No. 61/239,056, filed Sep. 1, 2009, entitled "INTEGRATED RF ELECTRODELESS PLASMA LAMP DEVICE AND METHODS" which is commonly owned and incorporated by reference in its entirety herein for all purposes.

BACKGROUND OF THE INVENTION

The present invention relates generally to lighting techniques. More particularly, the present invention provides a method and device using an electrodeless plasma lighting device having one of a plurality of base configurations. Merely by way of example, such configurations can include at least an Edison base or a mogul base, but can be others.

From the early days, human beings have used a variety of techniques for lighting. Early humans relied on fire to light caves during hours of darkness. Fire often consumed wood for fuel. Wood fuel was soon replaced by candles, which were derived from oils and fats. Candles were then replaced, at least in part by lamps. Certain lamps were fueled by oil or other sources of energy. Gas lamps were popular and still remain important for outdoor activities such as camping. In the late 1800, Thomas Edison, who is one of the greatest inventors of all time, conceived the incandescent lamp, which uses a tungsten filament within a bulb, coupled to a pair of electrodes. Many conventional buildings and homes still use the incandescent lamp, commonly called the Edison bulb. Although highly successful, the Edison bulb consumed much energy and was generally inefficient.

Fluorescent lighting replaced incandescent lamps for certain applications. Fluorescent lamps generally consist of a tube containing a gaseous material (typically Argon) and Mercury, which is coupled to a pair of electrodes. The electrodes are coupled to an electronic ballast, which helps ignite the discharge from the fluorescent lighting. Conventional building structures often use fluorescent lighting, rather than the incandescent counterpart. Fluorescent lighting is much more efficient than incandescent lighting, but often has a higher initial cost.

Shuji Nakamura pioneered the efficient blue light emitting diode, which is a solid state lamp. The blue light emitting diode forms a basis for the white solid state light, which is often a blue light emitting diode within a bulb coated with a yellow phosphor material. Blue light excites the phosphor material to emit white lighting. The blue light emitting diode has revolutionized the lighting industry to replace traditional lighting for homes, buildings, and other structures.

Another form of lighting is commonly called the electrodeless lamp, which can be used to discharge light for high intensity applications. Frederick Espiau was one of the pioneers that developed an improved electrodeless lamp. Such electrodeless lamp relied upon a solid ceramic resonator structure, which was coupled to a fill enclosed in a bulb. The bulb was coupled to the resonator structure via RF feeds, which transferred power to the fill to cause it to discharge high intensity lighting. Although somewhat successful, the electrodeless lamp still had many limitations, including the inability of the lamp to fit into standard light sockets such as the Edison socket or mogul socket.

From the above, it is seen that improved techniques for lighting are highly desired.

BRIEF SUMMARY OF THE INVENTION

According to the present invention, techniques generally for lighting techniques are provided. More particularly, the present invention provides a method and device using an electrodeless plasma lighting device having one of a plurality of base configurations. Merely by way of example, such configurations can include at least an Edison base, but can be others.

In a specific embodiment, the present invention provides an RF electrode-less plasma lighting device. The device has a base member, which includes an outer region capable of being coupled to first AC potential and an inner region capable of being coupled to a second AC potential. The device also has an AC to DC converter mechanically and integrally coupled to the base member. In a specific embodiment as an example only, the converter is a switching converter, but can be others. In a specific embodiment, the AC to DC converter has first AC contact region and a second AC contact region. In a specific embodiment, the first AC contact region is electrically coupled to the first potential and the second AC contact region is coupled to the second potential. In a specific embodiment, the AC to DC converter has a first DC output and a second DC output. The device also has an RF module mechanically and integrally coupled to the base member. In a preferred embodiment, the RF module has an RF source. The RF module has a first DC input and a second DC input. The first DC input of the RF module is coupled to the first DC output of the AC to DC converter and the second DC input of the RF module is coupled to the second DC output of the AC to DC converter. The RF source has an output and optionally has an input. In a specific embodiment, the device has an RF electrode-less plasma lighting assembly integrally coupled to the base member. The RF electrode-less plasma lighting assembly has an RF input, which is coupled to the output of the RF source.

In an alternative specific embodiment, the present invention provides an RF electrode-less plasma lighting device. The device has a base member, which has an outer region capable of being coupled to first AC potential and an inner region capable of being coupled to a second AC potential. In a preferred embodiment, the device has an RF module mechanically and integrally coupled to the base member. The RF module has an RF source, which has an output. The RF module has a first AC input and a second AC input. The first AC input of the RF module is coupled to the first AC potential and the second AC input of the RF module is coupled to the second AC potential. In a specific embodiment, the present device has an RF electrode-less plasma lighting assembly integrally coupled to the base member. The RF electrodeless plasma lighting assembly has an RF input, which is coupled to the output of the RF source.

Benefits are achieved over existing techniques using the present invention. In a specific embodiment, the present invention provides a method and device having configurations of input, output, and feedback coupling elements that provide for electromagnetic coupling to the bulb whose power transfer and frequency resonance characteristics in a suitable form factor. In a preferred embodiment, the present invention provides a method and configurations with an arrangement that provides for improved manufacturability as well as design flexibility. Other embodiments may include integrated assemblies of the output coupling element and bulb that function in a complementary manner with the present coupling element configurations and related methods for conventional lighting applications to replace the Edison socket or mogul socket. In a specific embodiment, the present method and resulting structure are relatively simple and cost effective to manufacture for commercial applications as well as simple to install into existing fixtures and sockets with minimal or no change to the existing fixtures. Depending upon the embodiment, one or more of these benefits may be achieved. These and other benefits may be described throughout the present specification and more particularly below.

The present invention achieves these benefits and others in the context of known process technology. However, a further understanding of the nature and advantages of the present invention may be realized by reference to the latter portions of the specification and attached drawings.

BRIEF DESCRIPTION OF THE DRAWINGS

A more complete understanding of the present invention and its advantages will be gained from a consideration of the following description of preferred embodiments, read in conjunction with the accompanying drawings provided herein. In the figures and description, numerals indicate various features of the invention, and like numerals referring to like features throughout both the drawings and the description.

DETAILED DESCRIPTION OF THE INVENTION

According to the present invention, techniques generally for lighting are provided. More particularly, the present invention provides a method and device using an electrodeless plasma lighting device having one of a plurality of base configurations. Merely by way of example, such configurations can include at least Edison base or mogul base, but can be others.

Figure 1A:
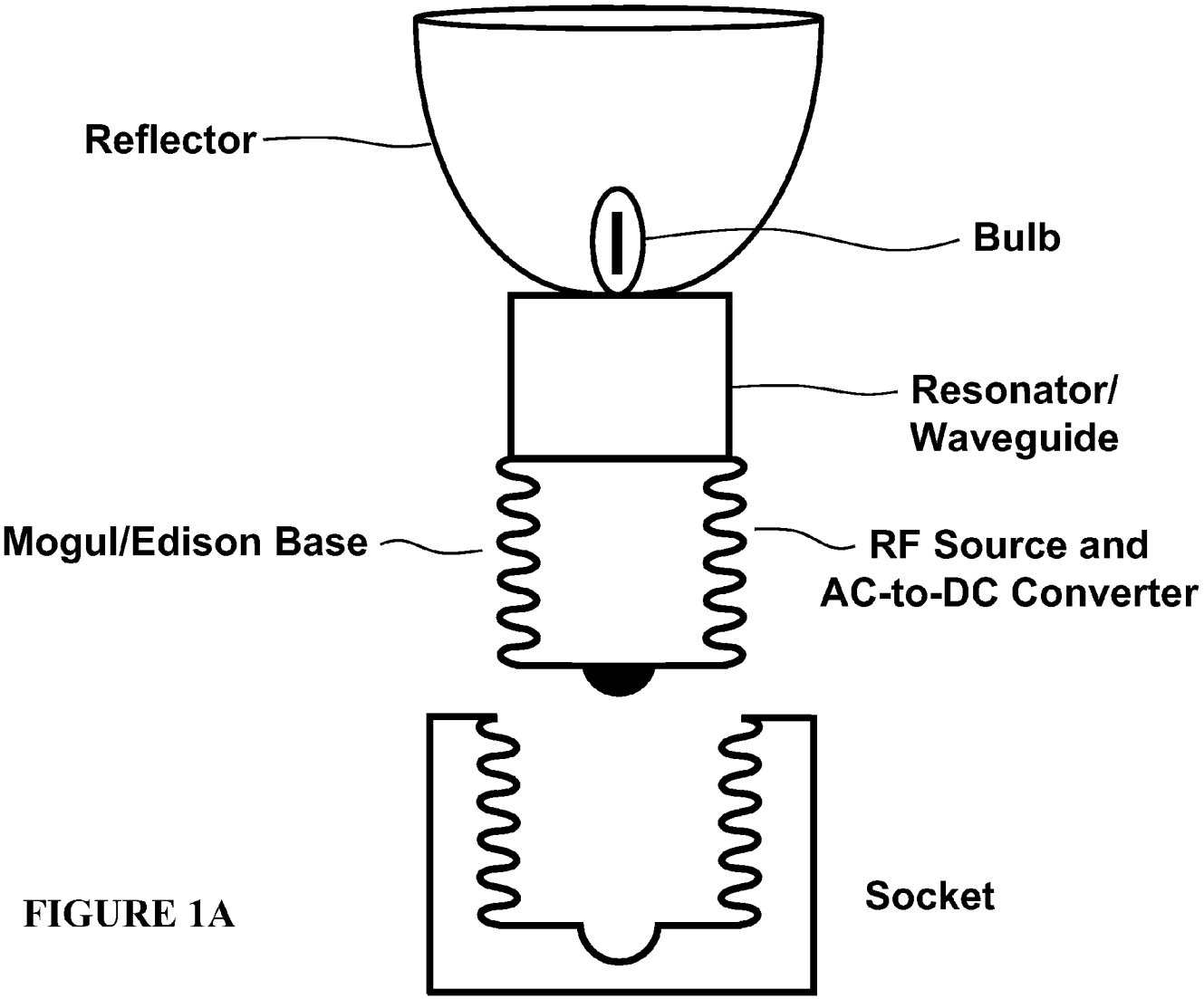
FIG. 1A is a simplified perspective view of an integrated base electrodeless plasma lamp according to an embodiment of the present invention.

FIG. 1A is a simplified perspective view of an electrodeless plasma lamp integrated with a base. The base integrated lamp includes a base that is mechanically and integrally coupled with the below described various plasma lamp assemblies. The base member can be of any suitable size and shape to fit into a socket, including but not limited to an Edison base. More specifically, the base member can be but is not limited to an E14, E17, E26, E27, E39 and E40 or any other Edison type base or mogul type base. The base provides two electrical inputs to create an electrical circuit, and allow for the powering of the lamp apparatus. The base is electrically couple to an RF source that is used to create an RF signal, which drives the lamp device to its resonance frequency, subsequently creating a plasma within the bulb that emits electromagnetic radiation. The RF source can either be a distributed oscillator circuit or a separate oscillator along with one or more amplifier stages. In some cases a reflector can also be incorporated as part of the integrated plasma lamp assembly.

Many advantages are created by utilizing an electrodeless plasma lamp integrated with a base. First, the compact design of the device leads to easier manufacturing at larger volumes and lower cost. Furthermore, the electrodeless plasma lamp has significantly higher efficacy than the typical incandescent bulb, while generating much higher luminous intensity. In addition the integrated plasma lamp assembly can fit into existing fixtures and lamp sockets with very little change or no change at all to existing fixtures. Finally, the electrodeless plasma lamp integrated with a base, has a much longer lifetime than typical incandescent bulbs.

Figure 1B:
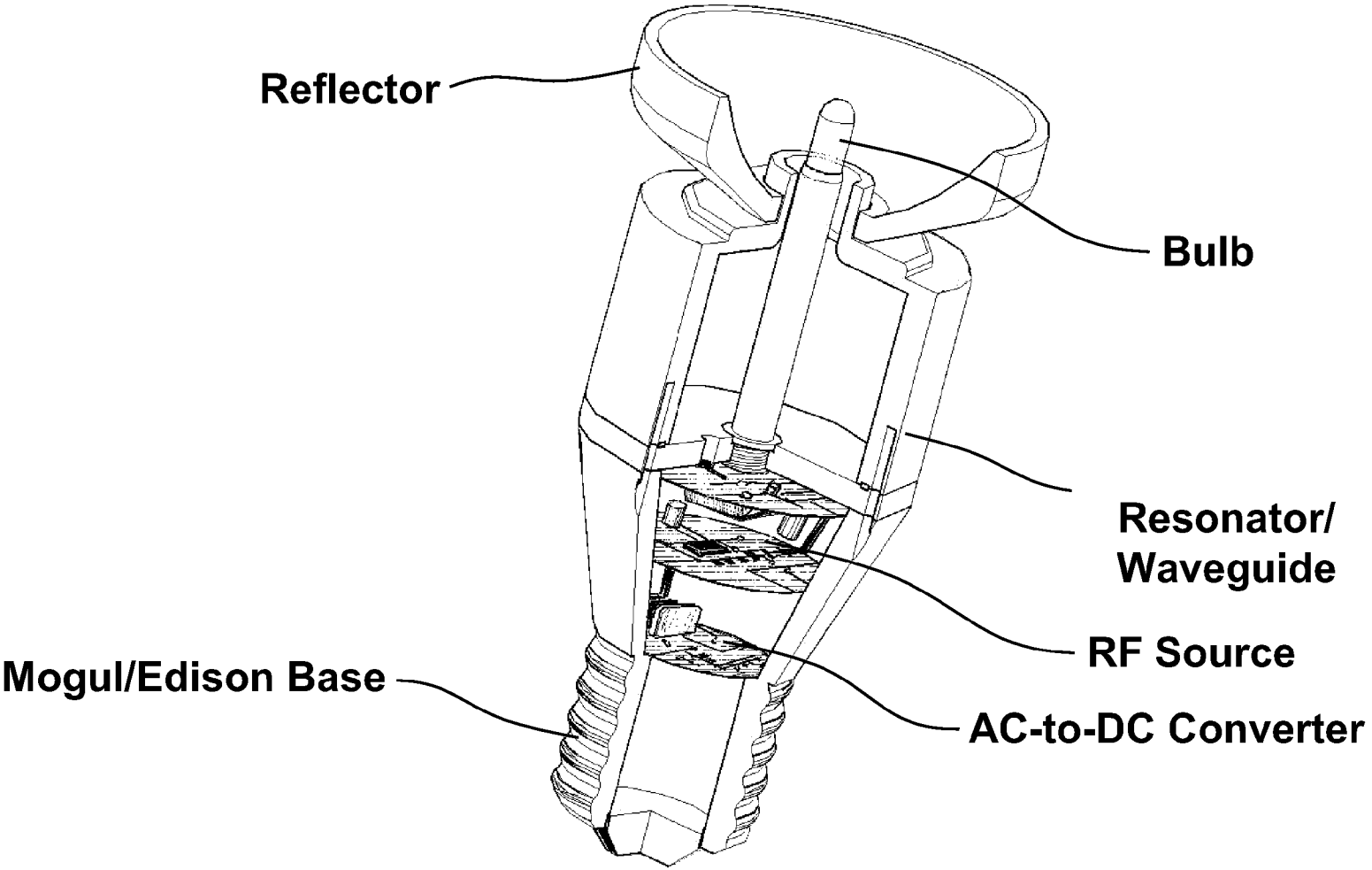
FIG. 1B is a simplified cross-sectional perspective view of an integrated base electrodeless plasma lamp according to an embodiment of the present invention.

FIG. 1B is a simplified cross-sectional perspective view of an electrodeless plasma lamp integrated with a mogul/Edison base. The bulb is attached to the output coupling element of the resonator/waveguide. The RF source/driver and the AC-to-DC converter are integrated into the base of the lamp. In some cases it is necessary to thermally isolate the resonator/waveguide assembly from the RF source. The lamp in this case also contains an integrated reflector. In other embodiments the base might include only the RF source/driver with the AC-to-DC converter being external to the integrated lamp assembly. The integrated plasma lamp is integrated with standard mogul/Edison bases such that it fits into existing sockets. This will significantly simplify and reduce the cost of integrating the electrodeless plasma lamps into existing fixtures.

Figure 2:
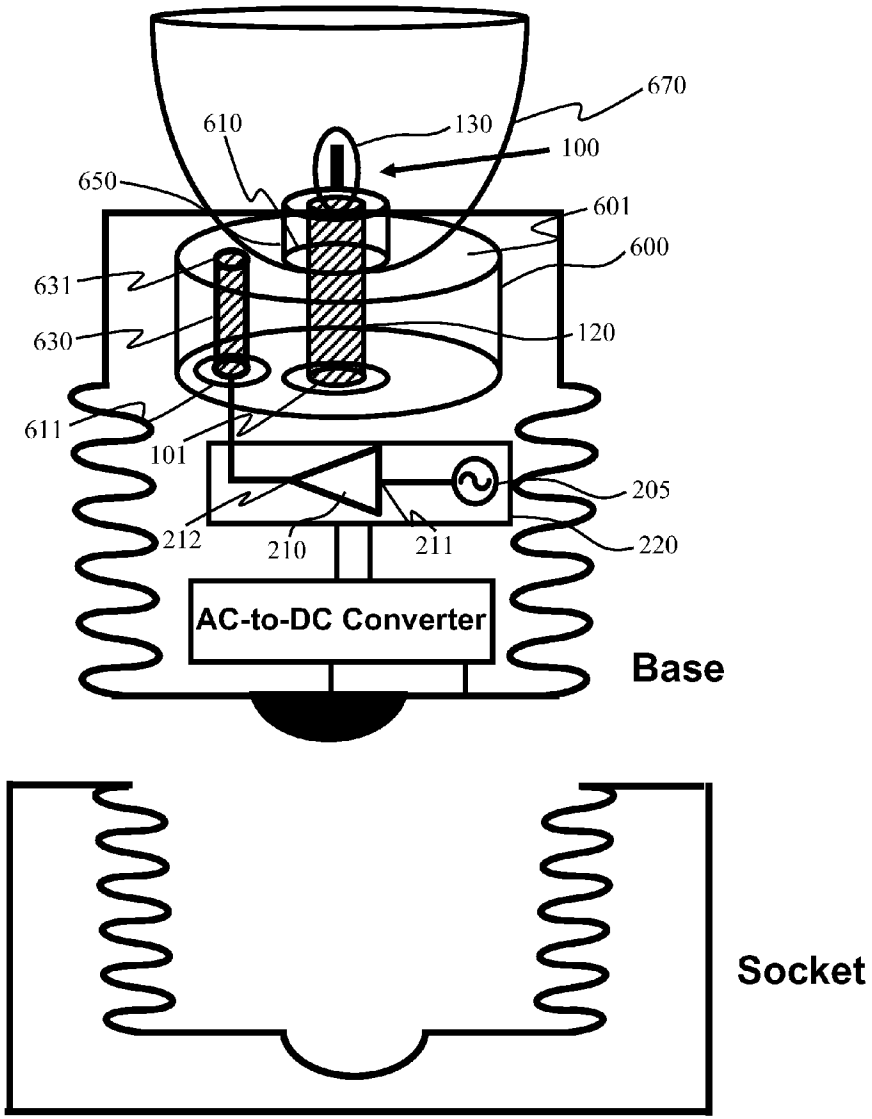
FIG. 2 is a simplified perspective view of an integrated base electrodeless plasma lamp integrating an AC to DC converter according to an embodiment of the present invention.

FIG. 2 shows a simplified perspective view of an electrodeless plasma lamp integrated with a base incorporating an AC to DC converter. The base member encompasses the entire RF module 220 and lamp body 600. The base member includes an outer region that is capable of being coupled to an AC potential and an inner region that is capable of being coupled to a second AC potential. The device provided by the present invention can also include a conductive housing that is coupled to the base member. Such conductive housing is used to efficiently conduct the first and second AC potentials to the base member. The housing can also be used to more efficiently dissipate thermal energy away from the base member.

Figure 4:
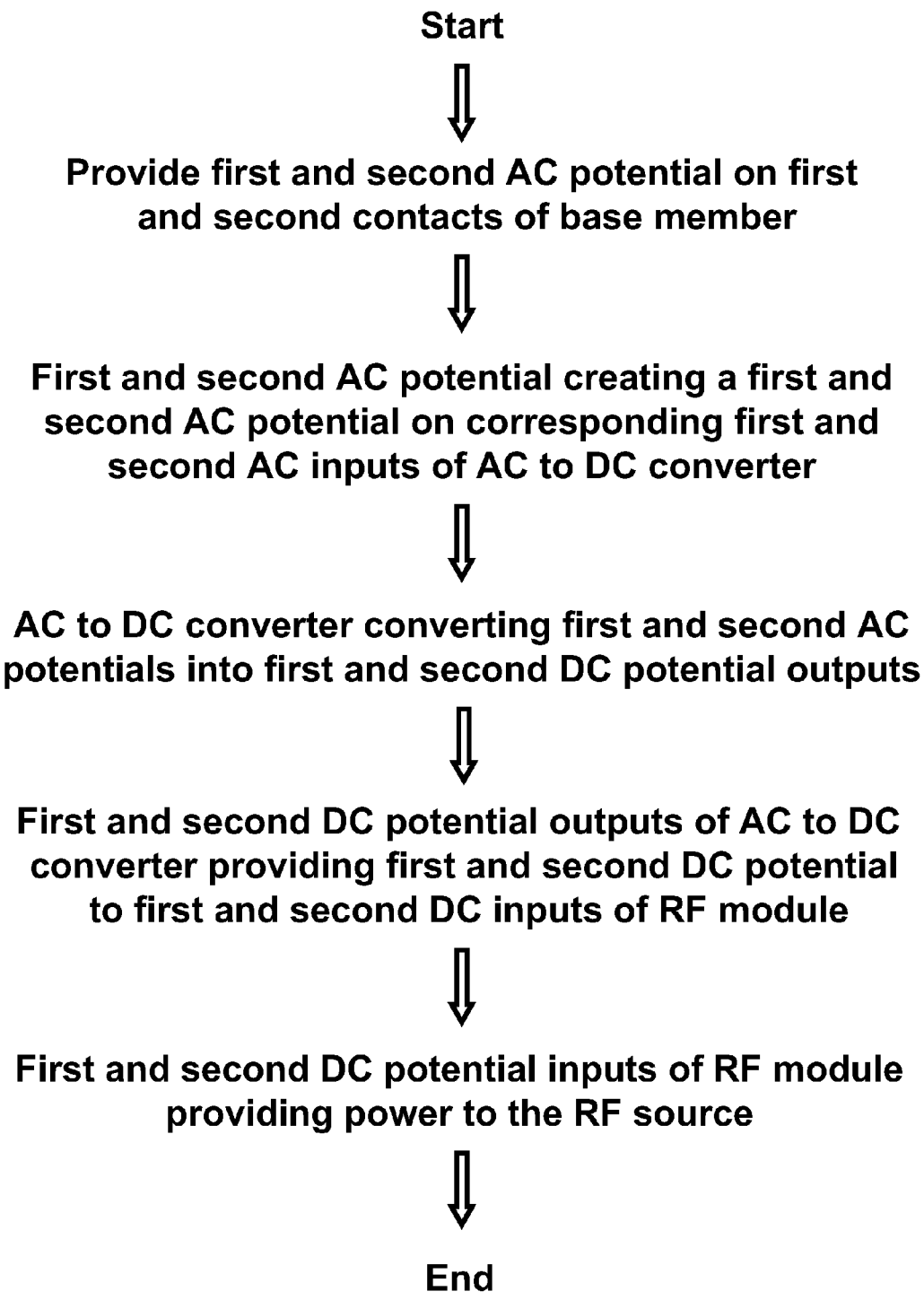
FIG. 4 is a simplified block diagram of the method used in transferring power to the RF source within the base assembly utilizing an AC to DC converter according to an embodiment of the present invention.

An AC to DC converter is integrated within the base member, and has a first AC contact region and a second AC contact region. The method by which the RF source within the socket base is powered is shown in the simplified block diagram of FIG. 4. The first AC contact region is electrically coupled to the first AC potential, while the second AC contact region is electrically coupled to the second AC potential. The AC to DC converter includes a first and second DC potential output. The AC to DC converter includes a switching converter and transformers, and is capable of converting between 50 and 400 W of power at an efficiency level of about 90%.

The RF module includes two inputs, the first input electrically coupled to the first DC potential output, and the second input electrically coupled to the second DC potential output. The RF module includes an RF source that is powered through the first and second DC potentials. The RF source has an output that is coupled to the RF input coupling element of the lamp body, which is in turn used to drive the entire assembly to resonate at the corresponding resonant frequency. The RF source can be in a frequency between about 10 MHz and 20 GHz. As mentioned previously, the RF module also includes an RF amplifier that has a gain of at least 20 dB and an efficiency of at least 75% but preferably higher. The integrated base electrodeless plasma lamp can also include a heat sink coupled to the RF source. The heat sink is used to dissipate thermal energy that is generated by the RF source, away from the RF source. Alternatively, the heat sink can be coupled to the base member to allow for the dissipation from the heat sink to the base member. Incorporating the heat sink within the device ensures that the RF source does not fail due to the buildup of thermal energy, thereby leading to improved device performance.

Figure 5:
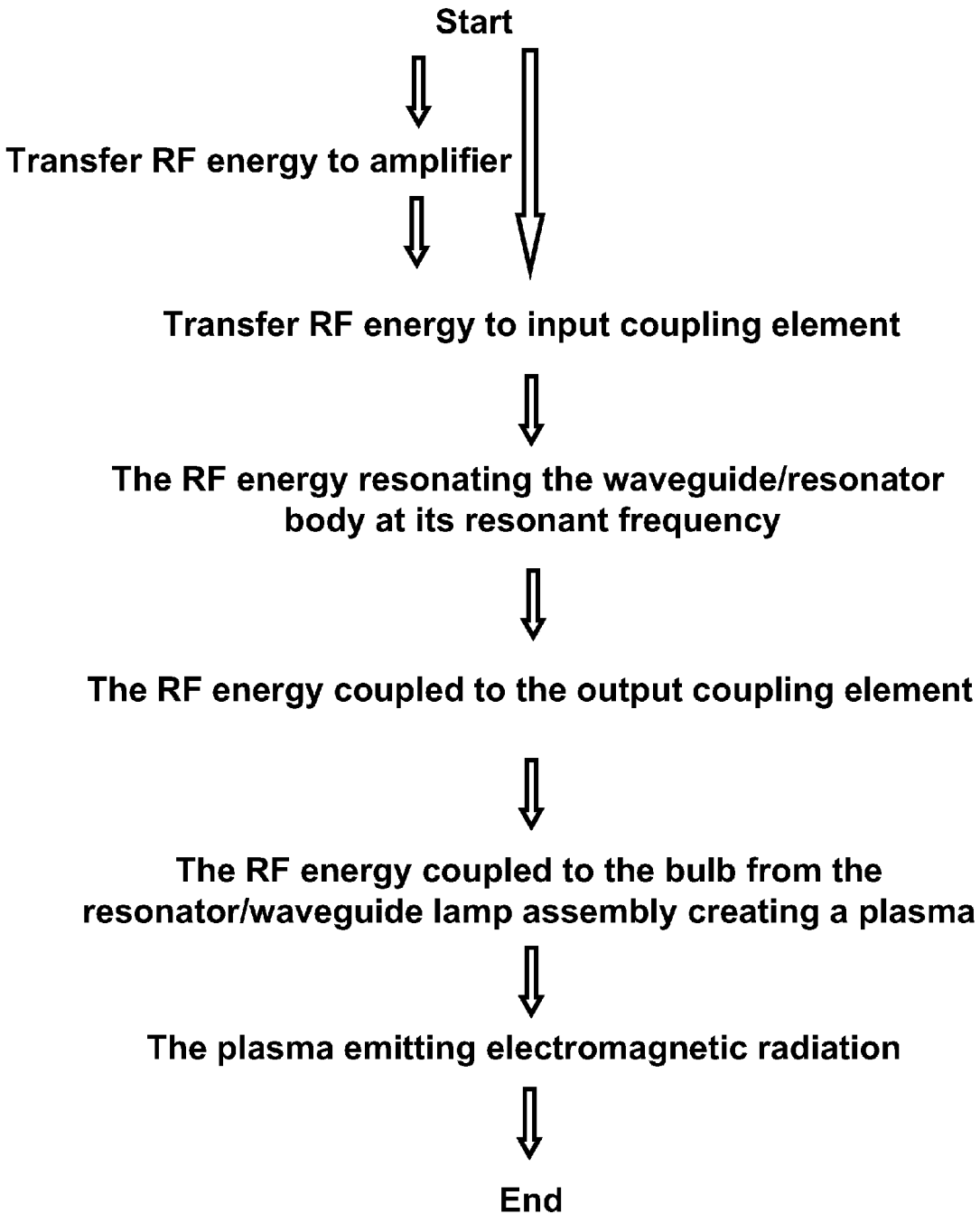
FIG. 5 is a simplified block diagram of the method used in creating a plasma within the bulb from the RF energy provided by the RF source according to an embodiment of the present invention.

The present invention employs a lamp body 600, whose outer surface 601 is electrically conductive and is connected to the second DC input. FIG. 2 is merely an example, which should not unduly limit the scope of the claims herein. One of ordinary skill in the art would recognize other variations, modifications, and alternatives. FIG. 5 shows a simplified block diagram of the method used in creating a plasma within the bulb from the RF energy provided by the RF source. A cylindrical lamp body is depicted, but rectangular or other shapes may be used. This conductivity may be achieved through the application of a conductive veneer, or through the choice of a conductive material. An example embodiment of conductive veneer is silver paint or alternatively the lamp body can be made from sheet of electrically conductive material such as aluminum. An integrated bulb/output coupling-element assembly 100 is closely received by the lamp body 600 through opening 610. The bulb/output coupling-element assembly 100 contains the bulb 130, which is a gas-filled vessel that ultimately produces the luminous output.

The bottom of the assembly 100, output coupling-element 120, is coupled to the second DC input to the waveguide body 600 and its conductive surface 601. The luminous output from the bulb is collected and directed by an external reflector 670, which is either electrically conductive or if it is made from a dielectric material has an electrically conductive backing, and which is attached to and in electrical contact with the body 600. The lamp apparatus includes a reflector 670 that is depicted as parabolic in shape with bulb 130 positioned near its focus. Those of ordinary skill in the art will recognize that a wide variety of possible reflector shapes can be designed to satisfy beam-direction and illumination requirements. In a specific embodiment, the shapes can be conical, convex, concave, trapezoidal, pyramidal, or any combination of these, and the like.

The lamp is driven by a separate oscillator 205 conductively connected with RF amplifier input 211 of the RF amplifier 210. RF amplifier output 212 is conductively connected with input coupling-element 630, also referred to as the RF source probe, which delivers RF power to the lamp/output coupling-element assembly 100, through the output coupling element 120, also referred to as the first probe. The resonant characteristics of the coupling between the input coupling-element 630 and the output coupling-element in the bulb/output coupling-element assembly 100 are frequency-matched to the RF source to optimize RF power transfer. Of course, there can be other variations, modifications, and alternatives.

The lamp/output coupling element assembly consists of a solid metal (metal post) 120 recessed at the top to receive the gas-filled vessel 130. The other end of the coupling-element is grounded to lamp body at surface 101. The top portion of the metal post is surrounded by metal ring. A thin layer of dielectric material or refractory metal such as molybdenum can be used as interface between the bulb and the metal post. Alternatively the top part of the metal post or all of the metal post can be made from a refractory metal with its outer surface covered with a layer of metal with high electrical conductivity such as silver or copper. The metal post can also be hollow inside. This diagram is merely an example, which should not unduly limit the scope of the claims herein. Examples of plasma lamp devices are described in "Electrodeless Lamps with Externally-Grounded Probes and Improved Bulb Assemblies," in the names of Espiau, Frederick M, Brockett, Timothy J., and Matloubian, Mehran, as listed as U.S. Ser. No. 61/075,735 filed Jun. 25, 2008, commonly assigned, and hereby incorporated by reference herein. Other examples include U.S. Pat. No. 7,362,056, among others, which are assigned to Luxim Corporation of Sunnyvale, Calif. One of ordinary skill in the art would recognize other variations, modifications, and alternatives.

A significant advantage of the invention is that the input coupling-element 630 and the bulb/output coupling-element assembly 100 are respectively connected to the second DC input at planes 631 and 101, which are coincident with the outer surface of the body 600. This eliminates the need to fine-tune their depth of insertion into the lamp body—as well as any sensitivity of the RF coupling between them to that depth—simplifying lamp manufacture, as well as improving consistency in lamp brightness yield.

Figure 3:
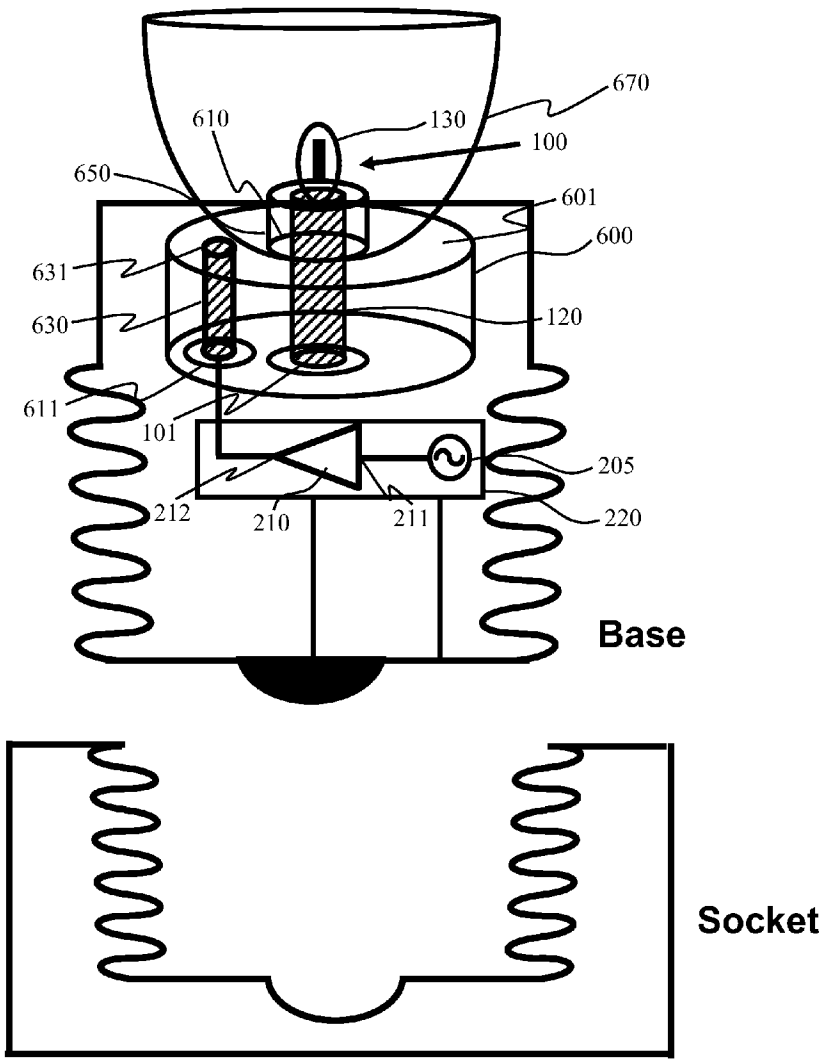
FIG. 3 is a simplified perspective view of an integrated base electrodeless plasma lamp without an integrated AC to DC converter according to an embodiment of the present invention.

In an alternate embodiment of the preset invention shown in FIG. 3, an integrated base electrodeless plasma lamp device is provided. The device is different from that in FIG. 2, in that an AC to DC converter is not used to create DC power for the RF source, but instead the RF module 220 is coupled directly to the AC potential inputs of the base member. As with the previous embodiment, the device includes a base member with an outer region that is coupled to a first AC potential and an inner region that is coupled to a second AC potential. The base member can be an E14, E17, E26, E27, E39 and E40 or any other Edison type base or mogul type base. The device provided by the present invention can also include a conductive housing that is coupled to the base member. Such conductive housing is used to efficiently conduct the first and second AC potentials to the base member. The housing can also be used to more efficiently dissipate thermal energy away from the base member.

The RF module includes an RF source. The RF module can include an RF amplifier with a gain that is at least 20 dB and an efficiency level of at least 75% but preferably higher. Unlike the previous embodiment, the RF source is coupled directly to the first and second AC potential inputs, to adequately power the RF source. A heat sink can be incorporated with the RF power source to efficiently dissipate thermal energy that is generated by the RF power source, away from the RF power source. The RF power source, in turn, outputs RF signals ranging from about 10 MHz to 20 GHz. The RF module is coupled to the RF input coupling element of the lamp, where the output signals that are generated by the RF source are used to resonate the entire RF plasma lamp device at its resonant frequency, thereby creating a plasma within the bulb and subsequently creating a luminous output.

The bulb includes a gas-filled vessel that is made of a suitable material such as quartz or other transparent or translucent material. The gas-filled vessel is filled with an inert gas such as Argon and a fluorophor or light emitter such as Mercury, Sodium, Dysprosium, Sulfur or a metal halide salt such as Indium Bromide, Scandium Bromide, or Cesium Iodide (or it can simultaneously contain multiple fluorophors or light emitters). The gas-filled vessel can also includes a metal halide, or other metal pieces that will discharge electromagnetic radiation according to a specific embodiment. Of course, there can be other variations, modifications, and alternatives.

In an alternate embodiment of the present invention, the RF module consists of a semiconductor device that acts as the RF source. The semiconductor device has a breakdown voltage that is at least greater than 100 V and preferably greater than 200 V. The semiconductor device can be silicon-based transistor or thyristor. Alternatively, the semiconductor device can be a silicon-carbide based transistor or thyristor, a gallium-nitride based transistor or thyristor, or a gallium-arsenide based transistor or thyristor. By using such semiconductor devices in the RF module, a further reduction in sizes of the overall plasma lamp lighting device is provided.

In an alternate embodiment of the present invention, an external AC-to-DC converter is used to provide DC input to the socket and through the socket to the base of the integrated plasma lamp. The DC input will provide power to the RF module which then provides RF power to the input of the resonator/waveguide to light up the bulb.

Figure 6:
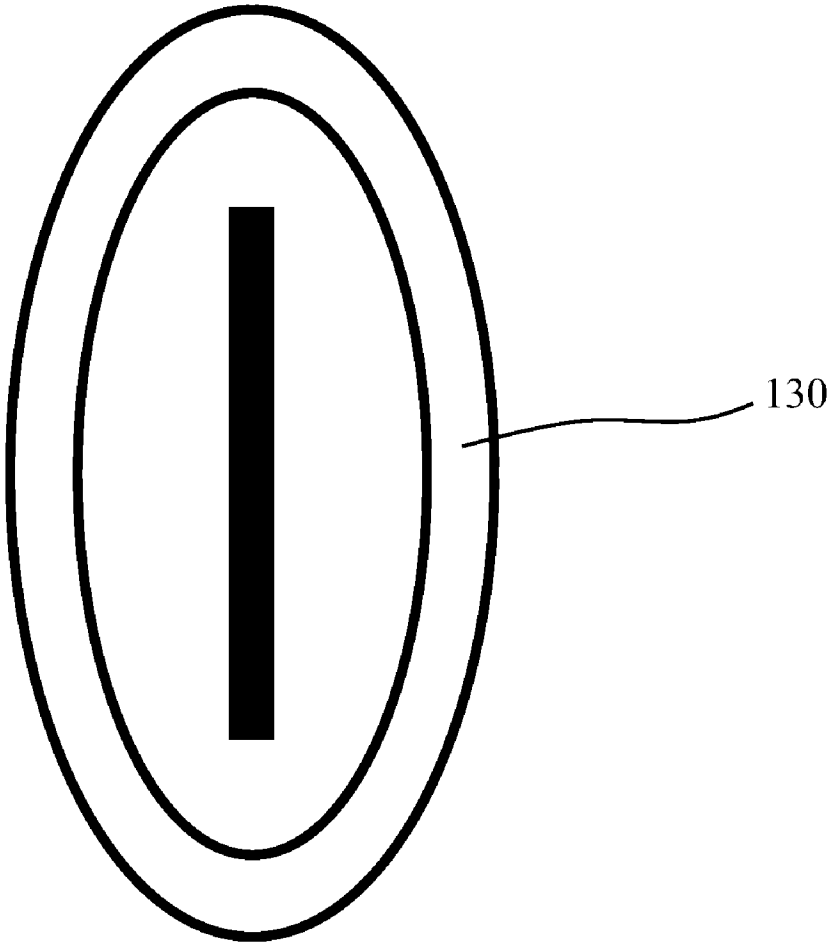
FIG. 6 is a simplified side view of the bulb that is resonated to create a plasma according to an embodiment of the present invention.

FIG. 6 shows a simplified cross sectional view of the bulb of the present invention. In a specific embodiment, the gas-filled vessel is made of a suitable material such as quartz or other transparent or translucent material. The gas-filled vessel is filled with an inert gas such as Argon and a fluorophor or light emitter such as Mercury, Sodium, Dysprosium, Sulfur or a metal halide salt such as Indium Bromide, Scandium Bromide, or Cesium Iodide (or it can simultaneously contain multiple fluorophors or light emitters). The gas-filled vessel can also includes a metal halide, or other metal pieces that will discharge electromagnetic radiation according to a specific embodiment. Of course, there can be other variations, modifications, and alternatives.

Figure 7:
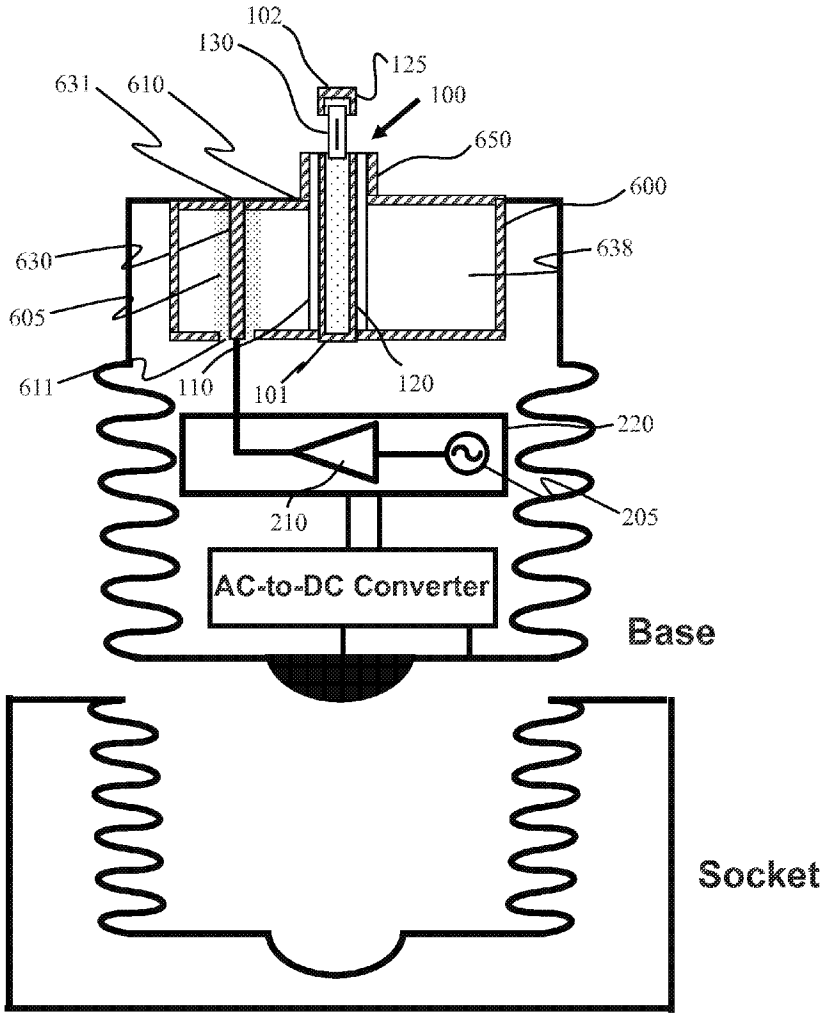
FIG. 7 is a simplified side view of an integrated base electrodeless plasma lamp that includes a lamp body that is filled with air and uses a dielectric layer around the input coupling-element to prevent arcing, the RF source powered with two DC potential inputs through an AC to DC converter.
Figure 8:
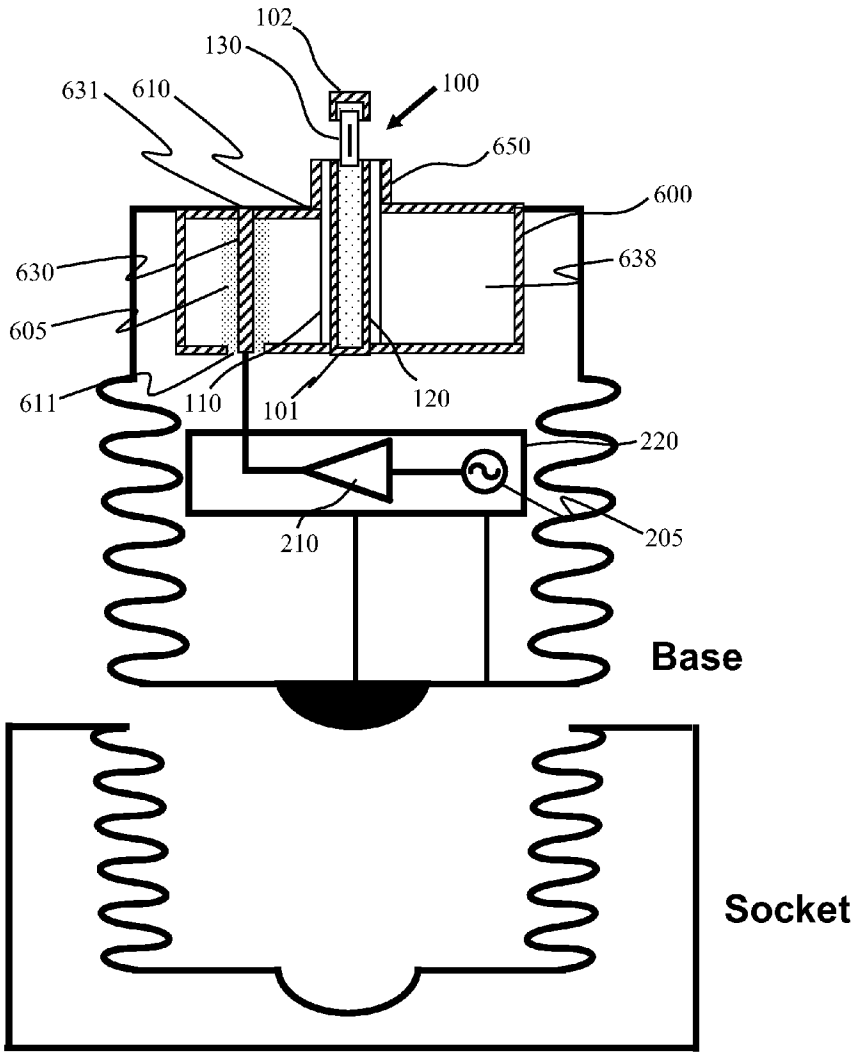
FIG. 8 is a simplified side view of an alternate integrated base electrodeless plasma lamp that includes a lamp body that is filled with air and uses a dielectric layer around the input coupling-element to prevent arcing, the RF source powered directly through two AC potential inputs.

FIGS. 7 and 8 show side cut views of an alternate electrodeless lamp design, employing the lamp body/metallic enclosure shown utilizing an AC to DC converter and not utilizing a AC to DC converter. This diagram is merely an example, which should not unduly limit the scope of the claims herein. One of ordinary skill in the art would recognize other variations, modifications, and alternatives. The inside of lamp body 638 is substantially low. A dielectric layer 605 such as Teflon is used around the input coupling-element 630, also referred to as the RF source probe, to prevent arcing. The end of the input coupling-element 631 is connected to the lamp body which is connected to the second electrical potential input, either AC or DC depending on the embodiment. The lamp assembly includes a gas-filled vessel 130 having an output coupling-element 120, also referred to as the first probe, and a top coupling element 125, also referred to as the second probe. The lamp assembly is also connected to the second potential input at planes 101 and 102. The lower section of the lamp assembly 110 which is inside lamp body 600 is not covered with any metal. This allows RF energy to be coupled from the input coupling-element 630 to the output coupling-element 120. The coupling and the impedance match to the bulb depends on the separation between the two coupling-elements and their dimensions including length and diameter. The resonant frequency of the lamp body and lamp assembly is strongly dependent on the length of the output coupling-element and the separation between the output coupling element and top portion of lamp body 650 and is less dependent on the diameter of the cylindrical lamp body.

Figure 9:
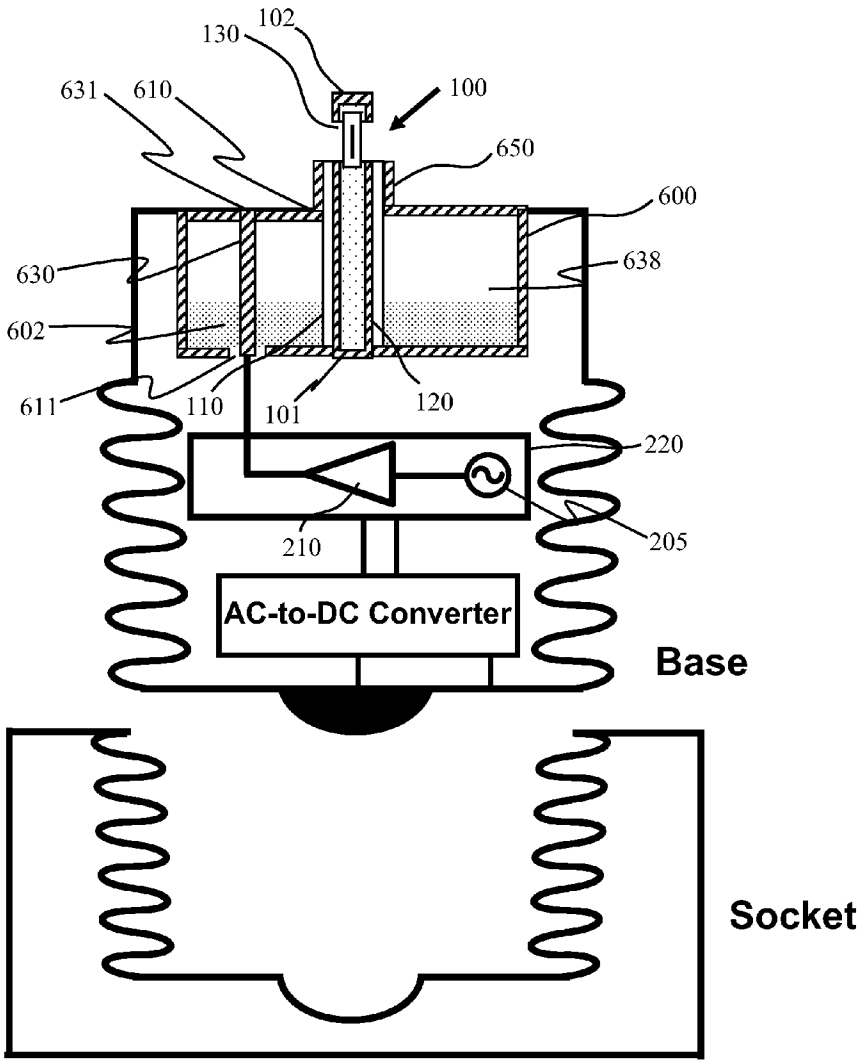
FIG. 9 is a simplified view of an alternate integrated base electrodeless plasma lamp where the lower part of the lamp body is partially filled with dielectric according to an embodiment of the present invention, the RF source powered with two DC potential inputs through an AC to DC converter.
Figure 10:
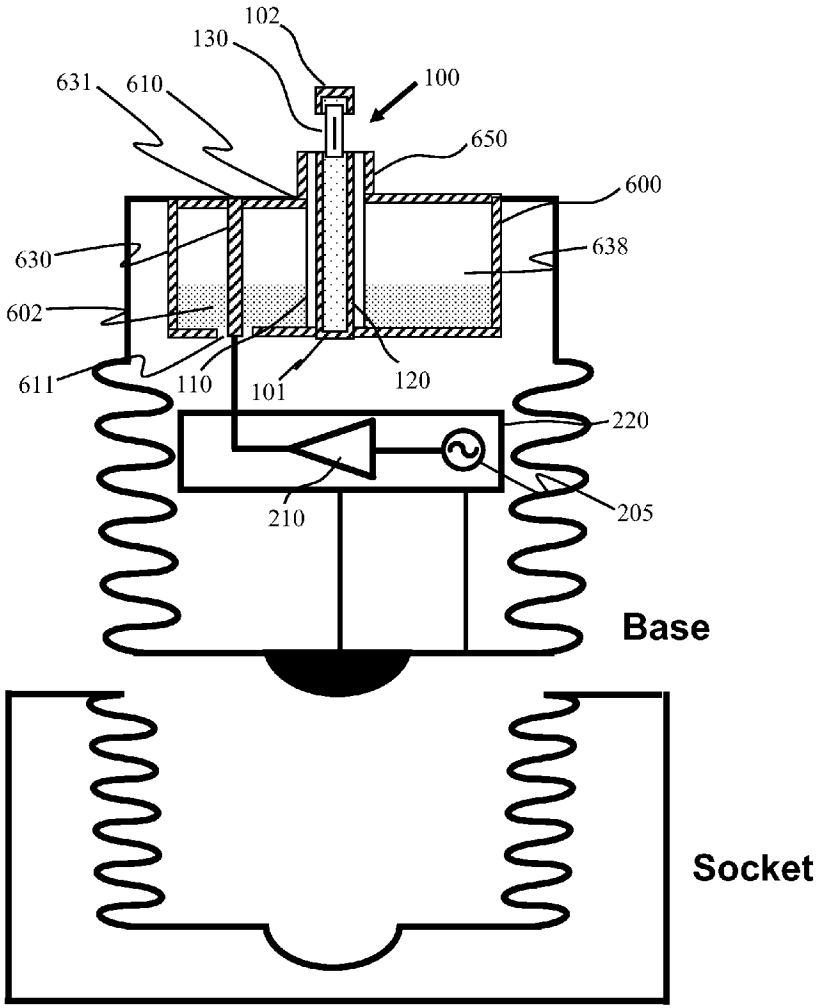
FIG. 10 is a simplified view of an alternate integrated base electrodeless plasma lamp where the lower part of the lamp body is partially filled with dielectric according to an embodiment of the present invention, the RF source powered directly through two AC potential inputs.

FIGS. 9 and 10 show simplified side views of alternate integrated lamp socket designs with the lower part of the lamp body partially filled with a dielectric material, powered through either AC or DC potential inputs. This diagram is merely an example, which should not unduly limit the scope of the claims herein. One of ordinary skill in the art would recognize other variations, modifications, and alternatives. This design is similar to that shown in FIGS. 7 and 8 except that the lamp body 600 is partially filled with dielectric 602 in the lower part of the lamp body. In an alternate design, the lamp body 600 that is partially filled with dielectric except that the dielectric layer is cylindrical surrounding the output coupling-element of lamp assembly. It is also possible that the lamp body is completely filled with a dielectric.

While the above is a full description of the specific embodiments, various modifications, alternative constructions and equivalents may be used. Therefore, the above description and illustrations should not be taken as limiting the scope of the present invention which is defined by the appended claims.

What is claimed is:

1. An RF electrodeless plasma lighting device comprising:

a base member, the base member having an outer region for coupling to first AC potential and an inner region for coupling to a second AC potential;

an AC to DC converter mechanically and integrally coupled to the base member, the AC to DC converter having first AC contact region and a second AC contact region, the first AC contact region being electrically coupled to the first potential and the second AC contact region being coupled to the second potential, the AC to DC converter having a first DC output and a second DC output;

an RF module mechanically and integrally coupled to the base member, the RF module having an RF source, the RF module having a first DC input and a second DC input, the first DC input of the RF module being coupled to the first DC output of the AC to DC converter and the second DC input of the RF module being coupled to the second DC output of the AC to DC converter, the RF source having an output; and an RF electrodeless plasma lighting assembly integrally coupled to the base member, the RF electrodeless plasma lighting assembly having an RF input, the RF input being coupled to the output of the RF source;

wherein the RF electrodeless plasma lighting assembly comprising:

a conductive housing having a spatial volume defined within the conductive housing, the spatial volume having an inner region and an outer region;

a support body having an outer surface region disposed within or partially within the inner region of the spatial volume of the conductive housing and a conductive material overlying the outer surface region of the support body;

a gas filled vessel having a transparent or translucent body having an inner surface and an outer surface and a cavity formed within the inner surface, the gas filled vessel comprising a first end region and a second end region and a length defined between the first end region and the second end region;

a first probe coupled to the first end region of the gas filled vessel, the first probe being electrically coupled to the conductive material;

a second probe coupled to the second end region of the gas filled vessel;

an RF source probe spatially disposed within the outer region of the conductive housing and within a predetermined distance from the first probe;

a gap provided between the source probe and the first probe; and a coupling element for inductively and/or capacitively coupling to the output of the RF source.

2. The device of claim 1 wherein the RF source being capable of outputting a signal ranging from about 10 MHz to about 20 GHz.

3. The device of claim 1 further comprising a heat sink member operably coupled to the RF module to facilitate transfer of thermal energy from the RF source during operation of the RF source.

4. The device of claim 1 wherein the RF source comprises an RF amplifier, the RF amplifier having a gain of greater than twenty dB.

5. The device of claim 4 wherein the RF amplifier has an efficiency of greater than about 80%.

6. The device of claim 1 wherein the base member is selected from an E14, E17, E26, E27, E39 and E40 or any other Edison type base or mogul type base.

7. The device of claim 1 wherein the gap comprises a dielectric material.

8. The device of claim 1 wherein the AC to DC converter is a switching converter.

9. The device of claim 1 wherein the AC to DC converter operates at an efficiency of greater than about 90%.

10. The device of claim 1 wherein the AC to DC converter is capable of converting at least 400 W of DC power.

11. The device of claim 1 wherein the base member includes at least one heat sink to improve the heat dissipation character of the RF electrodeless plasma lamp device.

12. An RF electrodeless plasma lighting device comprising:

a base member, the base member having an outer region for coupling to a first AC potential and an inner region for coupling to a second AC potential;

an RF module mechanically and integrally coupled to the base member, the RF module having an RF source, the RF module having a first AC input and the second AC input, the first AC input of the RF module being coupled to the first AC potential and the second AC input of the RF module being coupled to the second AC potential, the RF source having an output;

an RF electrodeless plasma lighting assembly integrally coupled to the base member, the RF plasma lighting assembly having an RF input, the RF input being coupled to the output of the RF source;

wherein the RF plasma lighting assembly comprising:

a conductive housing having a spatial volume defined within the conductive housing, the spatial volume having an inner region and an outer region;

a support body having an outer surface region disposed within or partially within the inner region of the spatial volume of the conductive housing and a conductive material overlying the outer surface region of the support body;

a gas filled vessel having a transparent or translucent body having an inner surface and an outer surface and a cavity formed within the inner surface, the gas filled vessel comprising a first end region and a second end region and a length defined between the first end region and the second end region;

a first probe coupled to the first end region of the gas filled vessel, the first probe being electrically coupled to the conductive material;

an RF source probe spatially disposed within the outer region of the conductive housing and within a predetermined distance from the first probe;

a gap provided between the source probe and the first probe; and wherein the RF source comprising an output, the output of the RF source being inductively and/or capacitively coupled to the first probe through the gap and the source probe.

13. The device of claim 12 wherein the RF source being capable of outputting a signal ranging from about 10 MHz to about 20 GHz.

14. The device of claim 12 further comprising a heat sink member operably coupled to the RF module to facilitate transfer of thermal energy from the RF source during operation of the RF source.

15. The device of claim 12 wherein the RF source comprises an RF amplifier, the RF amplifier having a gain of greater than twenty dB.

16. The device of claim 12 wherein the RF amplifier has an efficiency of greater than about 80%.

17. The device of claim 12 wherein the base member is selected from an E14, E17, E26, E27, E39 and E40 or any other Edison type base or mogul type base.

18. The device of claim 13 wherein the gap comprises a dielectric material.

19. The device in claim 12 wherein the RF module uses a semiconductor device that has a breakdown voltage of greater than at least 100 V and preferably more than 200 V and is capable of operating at the RF frequency of RF module.

20. The device in claim 19 wherein the RF module uses a silicon-based transistor or thyristor.

21. The device in claim 19 wherein the RF module uses a silicon-carbide based transistor or thyristor.

22. The device in claim 19 wherein the RF module uses a gallium-nitride based transistor or thyristor.

23. The device in claim 19 wherein the RF module uses a gallium-arsenide based transistor or thyristor.

* * * * *